United States Patent [19]

Brown et al.

[11] 3,990,187

[45] Nov. 9, 1976

[54] THERMAL BARRIER THRESHOLD

[75] Inventors: James R. Brown; Lorane C. Goss, Jr., both of Mechanicsburg, Pa.

[73] Assignee: Capitol Products Corporation, Mechanicsburg, Pa.

[22] Filed: July 19, 1973

[21] Appl. No.: 380,672

Related U.S. Application Data

[63] Continuation of Ser. No. 193,390, Oct. 28, 1971, abandoned.

[52] U.S. Cl. ..... 49/467

[51] Int. Cl.[2] ..... E06B 1/70

[58] Field of Search ..... 49/467, 468, 469, 470, 49/471

[56] References Cited

UNITED STATES PATENTS

| | | | |
|---|---|---|---|
| 2,718,677 | 9/1955 | Cornell | 49/469 |
| 3,083,420 | 4/1963 | Tinfow | 49/469 |
| 3,148,419 | 9/1964 | Straus et al. | 49/469 |
| 3,346,994 | 10/1967 | Kesler | 49/470 |
| 3,382,617 | 5/1968 | St. Aubin | 49/468 |
| 3,667,164 | 6/1972 | Coppins | 49/469 |

*Primary Examiner*—Philip C. Kannan

*Attorney, Agent, or Firm*—Donald L. Johnson; John F. Sieberth; Paul H. Leonard

[57] ABSTRACT

A threshold formed of an extruded aluminum shape and a plastic shape, the two shapes being interlocked and the plastic shape defining that part of the threshold inwardly of the bottom of a door and exposed to outside temperatures. The aluminum shape extends outwardly from the door and provides the base for the plastic threshold shape.

4 Claims, 3 Drawing Figures

THERMAL BARRIER THRESHOLD

This is a continuation division of application Ser. No. 193,390, filed on Oct. 28, 1971 now abandoned.

BACKGROUND OF THE INVENTION

The present invention relates to an improved combination plastic and metal threshold construction which retards thermal conductivity of heat out of a home or building.

The instant invention particularly relates to thresholds for use in doorways having a door hinged therein.

Prior art thresholds as exemplified in U.S. Pat. No. 3,346,994 are formed of three extruded aluminum shapes and a strip of insulating material, with two of the shapes being interlocked and defining that part of the threshold outwardly of the bottom of a door and which is exposed to outside temperatures. The third shape or base plate is mechanically interlocked with the insulating material which is in turn interlocked with the first two shapes, with the third shape extending inwardly from the door thermally insulated from the first two. A strip of resilient insulating material is also carried by the bottom edge of the door in position to sealingly engage the threshold. The present invention has a number of advantages over such prior art thresholds.

The present invention provides a threshold which can be manufactured with considerably less production costs and time. With the instant invention, all assembly time is eliminated.

Additionally, the present invention provides a threshold that can be readily replaced when damaged.

An important object of the present invention is to provide a complete thermal barrier as opposed to a thermal "break" as exemplified in the prior art construction.

SUMMARY OF THE INVENTION

The present invention comprises two basic parts, an extruded aluminum shape or base plate and a continuous plastic threshold, preferably made from PVC or other suitable rigid and strong plastic, which two parts are interlockingly engaged. The metal part defining the base has protruding members or legs extending therefrom which engage corresponding protruding members or legs extending from the plastic part defining the threshold. The legs of one part are so constructed that they interlock with their respective members on the other part.

DESCRIPTION OF THE PREFERRED EMBODIMENT

Figure 1:
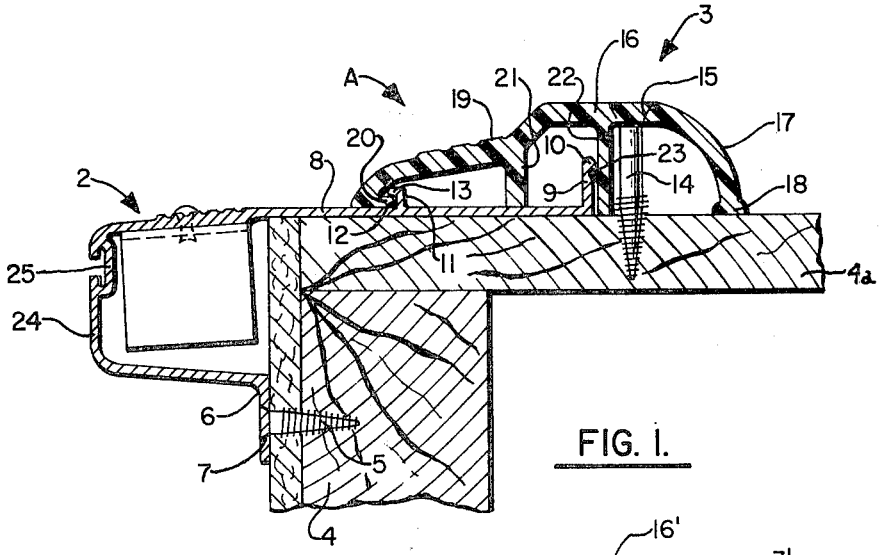
FIG. 1 is a sectional view representing a cross-section of the complete threshold of the present invention in its installed position.
Figure 2:
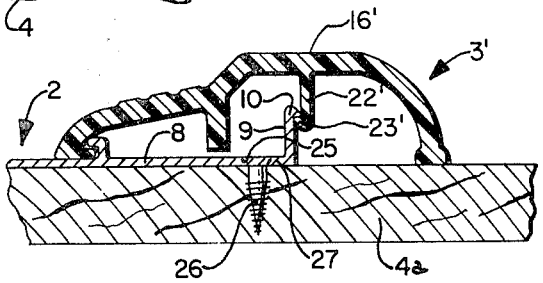
FIG. 2 is a sectional view of the plastic part of the threshold of the instant invention and a partial sectional view of the metal base plate illustrating an alternate means of installation; and, FIG. 3 is a perspective view of an end section of the plastic member and metal base of the threshold, showing the two parts separately and illustrating how they are joined together.
Figure 3:
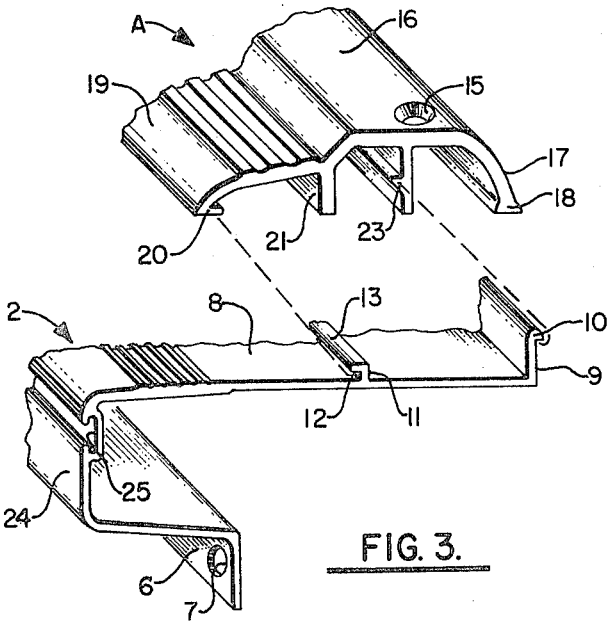

Referring to the drawings, in FIG. 1 and FIG. 2 thereof, the unique two component threshold structure of the present invention is indicated generally at A.

One component of the threshold structure A comprises a sill or base plate member 2 which is secured to a floor or framing member 4, usually of wood and which defines the bottom of a doorway in which a door is hinged in the normal manner. The door sill 2 is secured to the joist header 4 in any suitable manner, such as by means of screws 5. The outer edge or flange 6 of the base plate 2 has a plurality of openings 7 therein for receiving the screws 5. The openings 7 are spaced apart at suitable intervals longitudinally along the flange 6 of the base plate 2. The base plate 2 includes a generally horizontal base plate portion 8 which lays on the upper surface of the header 4. The inner edge of the base plate portion 8 extends upwardly to define an end flange or leg 9, and integral with the upper edge thereof is an outwardly extending longitudinal bead or lip 10. A rib 11 is formed integrally on the upper surface of the base plate 8 and is undercut at 12 forming a bent portion or outwardly extending leg 13. The rib extends parallel to the end flange or leg 9 but spaced therefrom, as shown. It should be understood that the base plate 2 is of an elongated shape and extends across the doorway from side to side thereof, as do all of the parts described herein.

The other component of the threshold structure A is a non-metallic threshold or outer trim plate 3. The threshold member 3 is preferably made of plastic and a polyvinyl chloride (PVC) plastic is especially preferred. The member 3 is a one-piece longitudinal member which is adapted to interlockingly engage with the base plate 2. The threshold 3 is connected to a subfloor **4*a* by any suitable means such as screws 14. Openings 15 are provided at suitable intervals longitudinally along the upper or flat portion 16 of the member 3 upon which the lower edge of a door is adjacent thereto when the door is in a closed position. One leg 17 of the member 3 is curved outwardly and forms a flange or extended leg which has an enlarged portion 18 at the end thereof which rests on the header or frame member 4*a*. The second leg 19 of the member 3 extends outwardly away from the flat portion 16 and away from the leg 17 and has a hooked member 20 at the end thereof which rests on the sill 2 on the header 4*a*. The hook 20 is also adapted to interlock with the rib 11 of the base plate 8. For supporting the leg 19 and the flat portion 16 a rib or extended leg 21 integrally formed with the member 3 extends from leg 19 and rests upon the base plate 8. Another member or leg 22 extends downwardly from the flat portion 16 also being integrally formed therewith and is of sufficient length to make contact with the header 4*a*. The leg 22 has a projecting member 23 which is adapted to interlockingly receive the lip 10 of the end flange or leg 9 of the base plate 8. The member 3 is thus snapped or locked into position on the base plate 8 thereby forming the integral thermal barrier threshold A. Since the member 3** is non-metallic, a complete thermal barrier is obtained. Such construction also facilitates the repair or replacement of damaged thresholds.

The base plate 8 is shown extending outwardly beyond the illustrated confines of the doorway and is configured to define an outer edge surface 24, in addition to defining an attaching portion or flange 6. The outer edge portion 24 is provided with an undercut groove 25 extending there across and in which a suitable resilient strip may be positioned, if desired. The strip serves as a weather stripping for engagement with an auxiliary door such as a storm or screen door, not shown. The outer edge surface 24 may be smooth and the undercut groove 25 eliminated, if desired.

An alternate embodiment of the non-metallic threshold portion of the invention is illustrated in FIG. 2 generally at 3'. The member 3' is of substantially the same shape and configuration as the member 3 except that the leg 22' extends only partially from the flat portion 16' and terminates in a hook portion 23'. The hooked member 23' is adapted to interlockingly engage the bead or lip 10 of the leg 9 of the base plate 2. The member 3' can be installed without the necessity of any screws or other fastening members; however, it is generally preferable in such instance to attach the end portion 25 of the flat portion 8 of the base plate 2 to the header 4 by means of suitable fasteners such as screws 26 inserted in suitable openings 27 at desirably spaced apart intervals longitudinally along the end portion 25.

It can readily be seen that screws or other suitable fasteners can be placed at a variety of locations as desired without departing from the scope of the present invention.

The base plate 2 and trim plate 3 may be made to any predetermined length, width or depth desired to accommodate a particular doorway. Although various materials having necessary strength and rigidity may be used, in constructing the novel threshold structure of this invention, in order to effect a good thermal barrier, the trim plate should preferably be of non-metallic material when the base plate is metal.

Aluminum is defined herein as including aluminum and aluminum alloys having sufficient structural integrity to be employed in the manufacture of thresholds and those aluminum materials customarily employed in the threshold construction area.

Plastic is defined in the usual sense and includes those plastics having sufficient structural integrity to be employed in the manufacture of thresholds and those plastic materials customarily employed in the threshold construction area. In addition to PVC plastic, ABS, styrene, fiberglass, reinforced plastic and like materials suitable for use in the instant invention are included in the term "plastic".

The foregoing disclosure and description of the invention is merely illustrative and explanatory thereof and various changes in the size, shape and materials, as well as in the details of the illustrated construction, may be made within the scope of the appended claims without departing from the spirit of the invention.

What is claimed is:

1. A threshold structure for a doorway consisting essentially of two one-piece components, a metal base plate for extending horizontally across the bottom of the doorway and a plastic trim plate for extending horizontally across the doorway on a portion of said base plate, a portion of said trim plate extending outwardly and downwardly on said base plate; another portion of said trim plate extending inwardly and downwardly away from said base plate and free of contact therewith; and integrally formed means on each of said base plate and said trim plate which are slidably engageable with each other, said integrally formed means on said base plate comprising an upwardly extending edge flange and an upwardly extending rib, said flange and said rib being spaced apart and extending longitudinally and parallel to each other, lip means on the upper portion of said flange and an outwardly extending member on said rib; said integrally formed means on said trim plate comprising a downwardly extending leg means and a downwardly and outwardly extending leg means, each of said leg means being spaced apart and extending longitudinally and parallel to each other, a projection means on said downwardly extending leg means and a hooked member on the end of said downwardly and outwardly leg means; said downwardly extending leg means being of sufficient length to rest on a header of the doorway when in an installed position and said projection means being located at an intermediate position on said downwardly extending leg means; and said lip means being slidably engageable with said projection means, and said outwardly extending member being slidably engageable with said hooked member; whereby when said integrally formed means on said base plate and said integrally formed means on said trim plate are slidably engaged with each other, said base plate and said trim plate are locked together.

2. A threshold structure for a doorway, comprising: a generally horizontal metal base plate for extending across the bottom of the doorway; a generally horizontal plastic outer trim plate for extending horizontally across the doorway and on a portion of said base plate; a portion of said trim plate extending outwardly and downwardly on said base plate; another portion of said trim plate extending inwardly and downwardly away from said base plate and free of contact therewith; locking means on said base plate for interlockingly receiving locking means on said trim plate; and locking means on said trim plate for interlockingly receiving said locking means on said base plate; said locking means on said base plate comprising an upwardly extending integral edge flange and an upwardly extending integral rib, said flange and said rib being spaced apart and extending longitudinally and parallel to each other, a lip on the upper portion of said flange integrally formed therewith and an outwardly extending leg on said rib integrally formed therewith, and said locking means on said trim plate comprising a downwardly extending leg having a projection thereon integrally formed therewith for being interlockingly received by said lip on said flange on said base plate, said downwardly extending leg being of sufficient length to rest on a header of the doorway and said projection thereon being at an intermediate position on said leg, and a downwardly and outwardly extending leg having a hooked member on the end thereof and integrally formed therewith for being interlockingly received by said outwardly extending leg on said rib on said base plate; whereby when said locking means on said base plate and said locking means on said trim plate are engaged, said base plate and said trim plate are locked together.

3. A threshold structure as defined in claim 2, wherein said base plate extends outwardly of the doorway then downwardly to define an outwardly facing edge surface.

4. A threshold structure as defined in claim 3, wherein said outwardly facing edge surface has an undercut groove therein and extending longitudinally across the doorway, said groove being adapted to receive a resilient strip of material for projecting from said edge surface for yieldable engagement with an auxiliary door.

* * * * *